US008961134B2

(12) United States Patent
Beeck

(10) Patent No.: US 8,961,134 B2
(45) Date of Patent: Feb. 24, 2015

(54) TURBINE BLADE OR VANE WITH SEPARATE ENDWALL

(75) Inventor: Alexander R. Beeck, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 855 days.

(21) Appl. No.: 13/171,678

(22) Filed: Jun. 29, 2011

(65) Prior Publication Data

US 2013/0004331 A1 Jan. 3, 2013

(51) Int. Cl.
*F01D 5/14* (2006.01)
*F01D 5/18* (2006.01)

(52) U.S. Cl.
CPC ..... *F01D 5/143* (2013.01); *F01D 5/145* (2013.01); *F01D 5/147* (2013.01); *F05D 2240/80* (2013.01)
USPC ..... 416/97 R; 416/193 A; 416/224; 416/248

(58) Field of Classification Search
CPC ..... F01D 5/143; F01D 5/145; F01D 5/147; F01D 9/04; F05D 2250/184; F05D 2240/80; F05D 2240/81
USPC .... 416/97 R, 193 A, 96 A, 97 A, 224, 241 R, 416/243, 248; 415/115, 191, 914
See application file for complete search history.

(56) References Cited

U.S. PATENT DOCUMENTS 4,012,167 A 3/1977 Noble
5,842,831 A 12/1998 Galke et al.
6,214,248 B1 4/2001 Browning et al.
6,984,101 B2 1/2006 Schiavo, Jr.
7,488,157 B2 2/2009 Marini et al.
7,604,456 B2 10/2009 Schiavo, Jr. et al.
7,607,889 B2 * 10/2009 Baldauf et al. ..... 416/97 R
7,690,890 B2 * 4/2010 Aotsuka et al. ..... 415/191
7,963,746 B2 * 6/2011 Baldauf et al. ..... 416/97 R
8,118,554 B1 * 2/2012 Liang ..... 416/97 R
8,251,665 B2 * 8/2012 Baldauf et al. ..... 416/193 A
8,333,563 B2 * 12/2012 Razzell ..... 416/193 A
2006/0233641 A1 10/2006 Lee et al.
2008/0135530 A1 6/2008 Lee et al.
2008/0232956 A1 * 9/2008 Baldauf et al. ..... 415/174.2
2009/0016881 A1 * 1/2009 Baldauf et al. ..... 416/95
2010/0028131 A1 * 2/2010 Arrell et al. ..... 415/115
2010/0158696 A1 * 6/2010 Pandey et al. ..... 416/243
2011/0008156 A1 1/2011 Prentice et al.
2011/0044818 A1 2/2011 Kuhne et al.
2011/0223005 A1 * 9/2011 Lee et al. ..... 415/115

* cited by examiner

*Primary Examiner* — Edward Look
*Assistant Examiner* — Jesse Prager

(57) ABSTRACT

A turbine engine airfoil structure including an airfoil adapted to be supported to extend across a gas passage for a hot working gas in a turbine engine. The airfoil structure further includes a platform structure located at one end of the airfoil and positioned at a location forming a boundary of the gas passage. The platform structure includes a platform member including a gas side surface extending generally perpendicular from the airfoil at a junction with the airfoil, and providing a structural connection to the airfoil. The platform structure further includes a separately formed platform cover attached to the platform member at the gas side surface. The platform cover extends from a location adjacent to one of the sidewalls of the airfoil, and includes an outer surface located for contact with the hot working gas passing through the gas path.

11 Claims, 3 Drawing Sheets

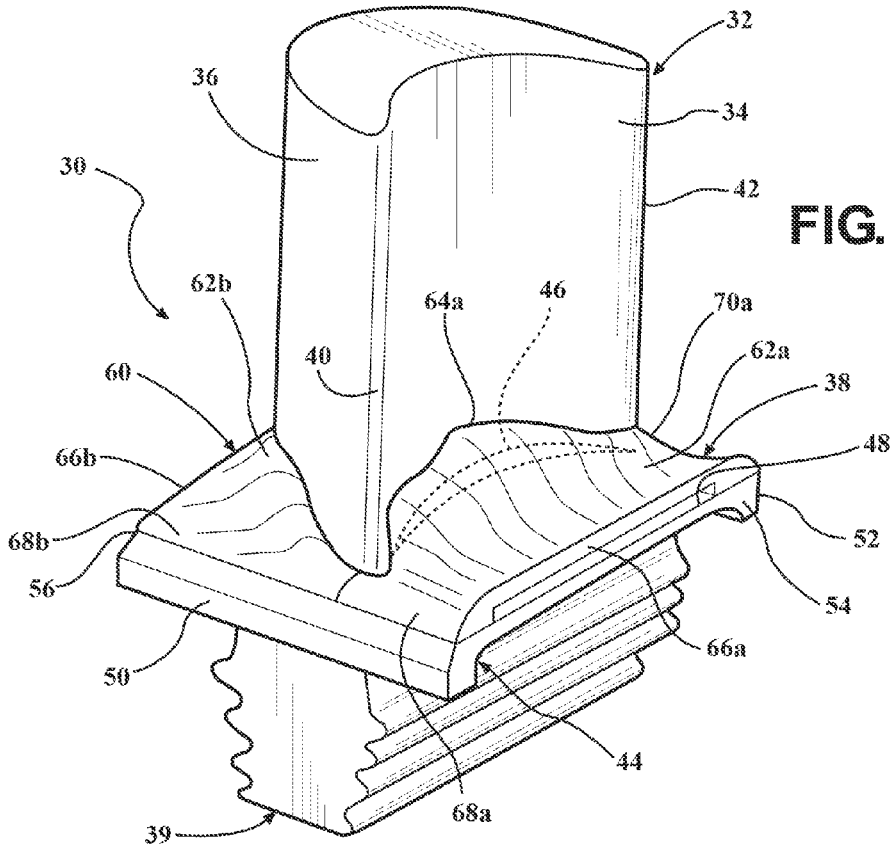
FIG. 2
FIG. 3
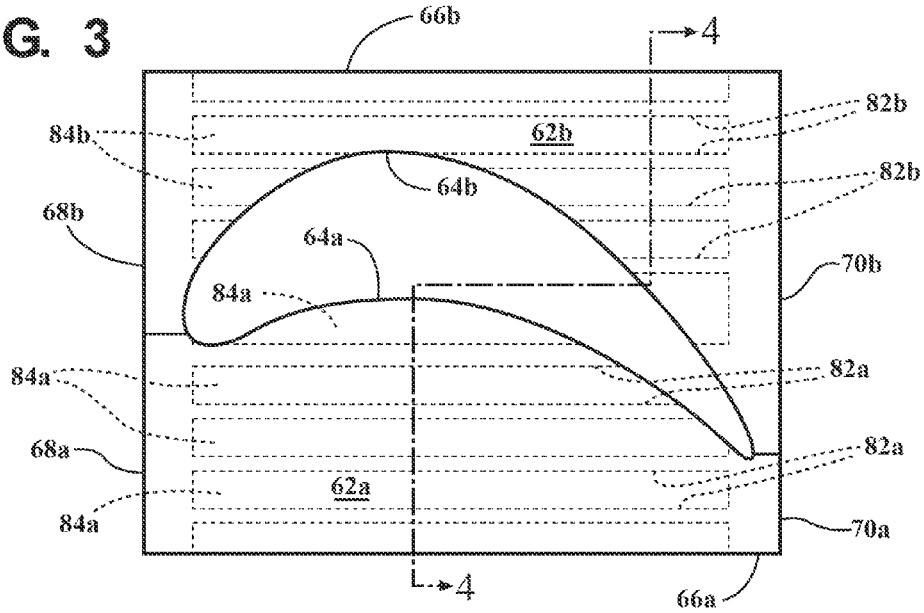

TURBINE BLADE OR VANE WITH SEPARATE ENDWALL

FIELD OF THE INVENTION

The present invention relates generally to turbine engines and, more particularly, to endwall structures for turbine engine vanes or blades.

BACKGROUND OF THE INVENTION

A gas turbine engine typically includes a compressor section, a combustor, and a turbine section. The compressor section compresses ambient air that enters an inlet. The combustor combines the compressed air with a fuel and ignites the mixture creating combustion products defining a working fluid. The working fluid travels to the turbine section where it is expanded to produce a work output. Within the turbine section are rows of stationary vanes directing the working fluid to rows of rotating blades coupled to a rotor. Each pair of a row of vanes and a row of blades form a stage in the turbine section.

Advanced gas turbines with high performance requirements attempt to reduce the aerodynamic losses as much as possible in the turbine section. This in turn results in improvement of the overall thermal efficiency and power output of the engine. One possible way to reduce aerodynamic losses is to incorporate endwall contouring on the blade and vane shrouds in the turbine section. Endwall contouring when optimized can result in a significant reduction in secondary flow vortices which may contribute to losses in the turbine stage.

SUMMARY OF THE INVENTION

In accordance with one aspect of the invention, a turbine engine airfoil structure is provided comprising an airfoil adapted to be supported to extend across a gas passage for a hot working gas in a turbine engine, the airfoil including sidewalls comprising radially extending pressure and suction sides. The airfoil structure further comprises a platform structure located at one end of the airfoil and positioned at a location forming a boundary of the gas passage. The platform structure includes a platform member including a gas side surface extending generally perpendicular from the airfoil at a junction with the airfoil, and providing a structural connection to the airfoil. The platform structure further includes a separately formed platform cover attached to the platform member at the gas side surface. The platform cover extends from a location radially displaced from the gas side surface and in contact with one of the sidewalls of the airfoil, and includes an outer surface located for contact with the hot working gas passing through the gas path.

In accordance with another aspect of the invention, a turbine engine airfoil structure is provided comprising an airfoil adapted to be supported to extend across a gas passage for a hot working gas in a turbine engine, the airfoil including sidewalls comprising radially extending pressure and suction sides. The airfoil structure further comprises a platform structure located at one end of the airfoil and positioned at a location forming a boundary of the gas passage. The platform structure includes a platform member including a gas side surface extending generally perpendicular from the airfoil at a junction with the airfoil, and providing a structural connection to the airfoil. The platform structure further includes a separately formed platform cover attached to the platform member at the gas side surface. The platform cover includes an outer surface located for contact with the hot working gas passing through the gas path, and the outer surface comprises a contoured endwall surface having a first edge located adjacent to one of the sidewalls.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

FIG. 2 is a perspective view of an airfoil structure illustrating aspects in accordance with the present invention;

FIG. 3 is a plan view of the airfoil structure of FIG. 1;

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
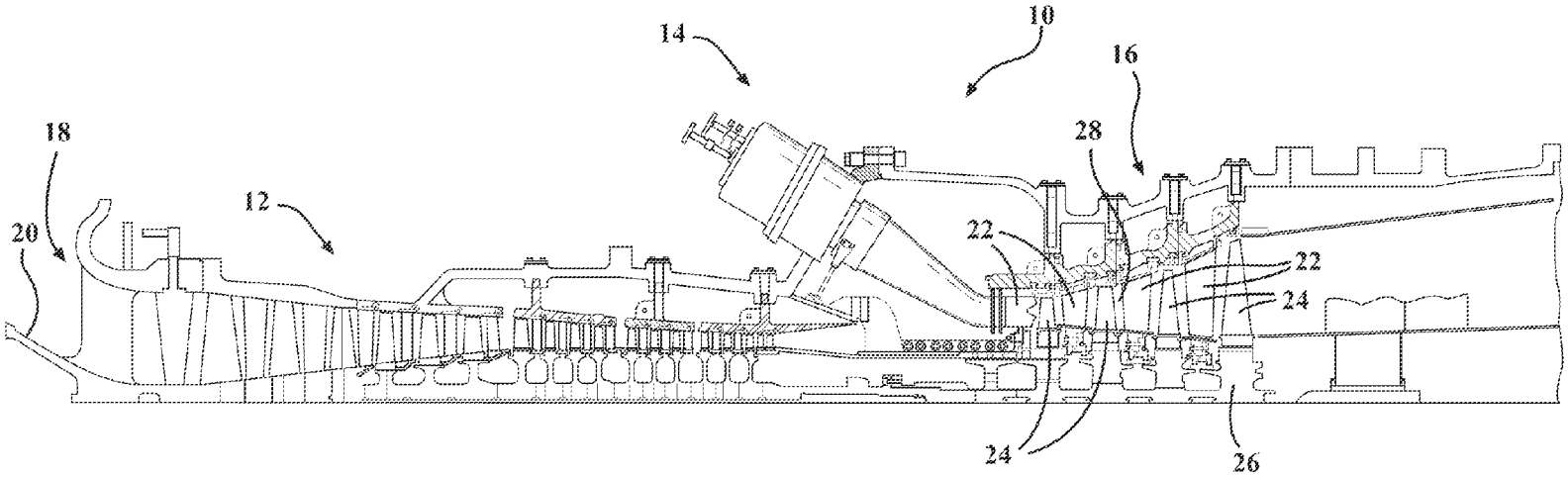
FIG. 1 is a partial cross-sectional view of a gas turbine engine incorporating an airfoil structure formed in accordance with aspects of the present invention.

In FIG. 1 a gas turbine engine 10 is illustrated including a compressor section 12, a combustor 14, and a turbine section 16. The compressor section 12 compresses ambient air 18 that enters an inlet 20. The combustor 14 combines the compressed air with a fuel and ignites the mixture creating combustion products comprising a hot working gas defining a working fluid. The working fluid travels to the turbine section 16. Within the turbine section 16 are rows of stationary vanes 22 and rows of rotating blades 24 coupled to a rotor 26, each pair of rows of vanes 22 and blades 24 forming a stage in the turbine section 16. The rows of vanes 22 and rows of blades 24 extend radially into an axial flow path 28 extending through the turbine section 16. The working fluid expands through the turbine section 16 and causes the blades 24, and therefore the rotor 26, to rotate. The rotor 26 extends into and through the compressor 12 and may provide power to the compressor 12 and output power to a generator (not shown).

Referring to FIG. 2, an airfoil structure 30 comprising one of the blades of the row of blades 24 is illustrated for the purpose of describing aspects of the present invention. However, it should be understood that the following description is not limited to implementation on an airfoil structure comprising a blade, and the described aspects of the invention may be implemented on other airfoil structures, such as may be implemented on a vane of the row of vanes 22.

Further, it should be understood that the terms "inner", "outer", "radial", "axial", "circumferential", and the like, as used herein, are not intended to be limiting with regard to an orientation or particular use of the elements recited for aspects of the present invention.

The airfoil structure 30 includes an airfoil 32 adapted to be supported to extend radially across the flow path 28. The airfoil 32 includes a generally concave sidewall 34 defining a pressure side of the airfoil 32, and includes an opposing generally convex sidewall 36 defining a suction side of the airfoil 32. The sidewalls 34, 36 extend radially outwardly from a shroud or platform structure 38, and extend generally axially in a chordal direction between a leading edge 40 and a trailing edge 42 of the airfoil 32. The platform structure 38 is located at one end of the airfoil 32 and is positioned at a location where it forms a boundary, i.e., an inner boundary, defining a portion of the flow path 28 for the working fluid. In addition, the airfoil structure 30 may include a root 39 extending radially inwardly from the airfoil 32 and platform structure 38 for retaining the airfoil structure 30 to the rotor 26.

The airfoil 32 is rigidly supported to a platform member 44 of the platform structure 38. As may be further seen in FIG. 4, a gas side surface 48 of the platform member 44 extends generally perpendicular from a junction with the airfoil 32. The gas side surface 48 extends axially between an upstream edge 50 and a downstream edge 52 of the platform member 44, and extends in a circumferential direction between opposing mateface sides 54 and 56 of the platform member 44. A junction structure, such as a fillet joint 46, may be provided extending from one or both of the sidewalls 34, 36 to the gas side surface 48 of the platform member 44. The fillet joint 46 provides a connection with a predetermined radius that may limit or reduce a stress concentration that may occur at the structural connection defined at the junction between the airfoil 32 and the platform member 44, and thus may facilitate increasing the life of the airfoil structure 30.

Figure 4:
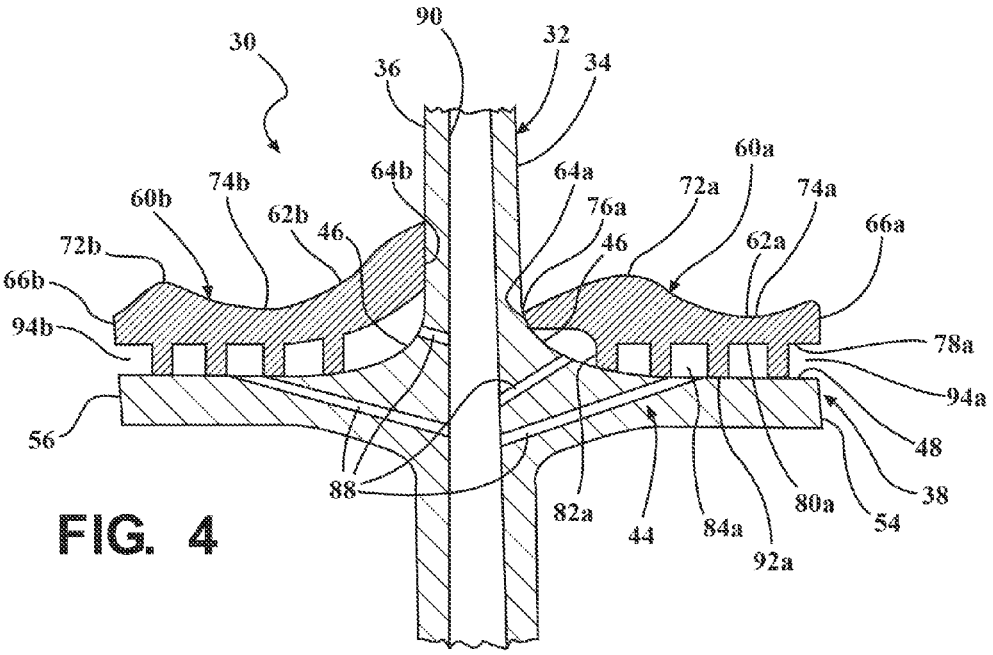
FIG. 4 is a cross sectional view taken along line 4-4 in FIG. 3.

Referring to FIG. 4, the platform structure 38 further includes a platform cover 60 (FIG. 2) which may comprise, for example, a pressure side platform cover 60*a* and a suction side platform cover 60*b*. That is, the platform cover 60 may comprise two or more platform covers 60*a*, 60*b*, or platform cover parts, such as to facilitate forming and mounting of the platform cover 60 on the platform member 44, although the present invention is not intended to be limited to a construction requiring more than a single platform cover 60. In the following description, particular reference is made to the pressure side platform cover 60*a*, and it is to be understood that the suction side platform cover 60*b* may comprise a similar structure, in which elements of the suction side platform cover 60*b* corresponding to elements of the pressure side platform cover 60*a* are identified with the same reference numerals having a suffix "b".

The platform cover 60*a* comprises an element or structure that is formed separately from the platform member 44 and, in particular, is formed separately from both the airfoil 32 and the platform member 44. Hence, in accordance with an aspect of the invention, the airfoil 32 and platform member 44 may be formed as a unitary or integral structure, such as by casting the airfoil 32 and platform member 44 as a single member. Alternatively, the airfoil 32 may be joined integrally to the platform member 44, such as by welding, and the platform cover 60*a* may subsequently be attached over the gas side surface 48 of the platform member 44 in a manner described below.

As may be further seen in FIGS. 2 and 3, the platform cover 60*a* includes an outer surface 62*a* extending generally circumferentially between a first or inner edge 64*a* and a second or outer edge 66*a*, and extending generally axially between an upstream edge 68*a* and a downstream edge 70*a*. The inner edge 64*a* may be located adjacent to or in engagement with the sidewall 34, where the outer surface 62*a* intersects the sidewall 34 at a location that may be radially displaced from the gas side surface 48. For example, the outer surface 62*a* may intersect the sidewall 34 at a location that is radially outwardly from the fillet joint 46. The outer surface 62*a* is located for contact with the hot working gas, and substantially isolates the gas side surface 48 from contact with the hot working gas.

Referring to FIG. 4, the outer surface 62*a* may be formed with a contour defining a contoured endwall for the airfoil structure 30. In particular, it may be desirable to provide the airfoil structure 30 with a contoured endwall, including contours such as one or more elevated ridges 72*a* and/or one or more depressed troughs 74*a* to minimize or reduce secondary flow vortices that may form in the flow field at the endwall between adjacent airfoil structures 30.

In accordance with an aspect of the platform cover 60*a*, the inner edge 64*a* may be provided with a configuration or contour for providing an improved aerodynamic efficiency adjacent to the joint 46 between the sidewall 34 and the platform member 44 that in a conventional construction of the joint may not be desirable from a structural or component strength standpoint. In particular, an aerodynamically efficient intersection of the outer surface 62*a* with the sidewall 34 at the inner edge 64*a* may form a sharp corner or angle 76*a*, and may comprise a corner defining an acute angle between the sidewall 34 and the outer surface 62*a*. Since the junction forming the structural connection between the sidewall 34 and the platform member 44 member may comprise a structurally preferable fillet joint 46, i.e., a curved or smooth transition, the separately formed platform cover 60*a* may enable provision of an aerodynamically efficient non-structural shaped member while maintaining structural integrity of the airfoil structure 30. The non-structural shaped member, as particularly defined at the inner edge 62*a*, may extend along a length of the sidewall 34 and may define a varying contour along the length of the inner edge 62*a*, see FIG. 2, to match the aerodynamic requirements at different locations along the airfoil 32. Further, formation of a contoured outer surface 62*a* on a separate member, i.e., on the platform cover 60*a*, distinct from the assembly of the airfoil 32 and platform member 44 may facilitate formation of particular contours, such as complex contours, that may be more difficult to manufacture with conventional techniques, such as by casting the contour directly on the gas side surface 48 of the platform member 44.

The present airfoil structure 30 may also facilitate formation of additional structure associated with an inner side 78*a* opposite from the outer side 62*a* of the platform cover 60*a*. For example, the inner side 78*a* may comprise a channel wall 80*a* formed on the platform cover 60*a* and facing toward the gas side surface 48. Further, support members 82*a* may extend from the channel wall 80*a* into engagement with the platform member 44, and support the platform cover 60*a* with the channel wall 80*a* in spaced relation to the gas side surface 48 of the platform member 44.

As may be seen in FIGS. 3 and 4, one or more cooling fluid channels 84*a* are defined in a space formed between the channel wall 80*a* and the gas side surface 48, and between adjacent support members 82*a*, permitting flow of cooling fluid. Hence, the platform cover 60*a* may facilitate provision of cooling channels 84*a* through the contoured surface, including additional cooling passages (not shown) that may be formed in or through the channel wall 80*a* and/or through the support members 82*a*, to provide controlled amounts of cooling flow, such as to improve uniformity of cooling for the heat load at the outer surface 62*a*. The construction of the airfoil structure 30 with a separately formed platform cover 60*a* may facilitate formation of the cooling channels 84*a*, i.e., separately formed cooling channels 84*a*, to customize the cooling provided to the varying thickness contours, while avoiding potentially complex manufacturing steps that may be required, such as complex core formations that may otherwise be required if similar cooling were to be provided by conventional methods of casting the cooling passages within the platform member 44.

The cooling channels 84*a* may be provided with a cooling fluid, such as cooling air, via cooling fluid passages 88 extending through at least a portion of either or both of the airfoil 32 and the platform member 44. The cooling fluid passages 88 receive cooling fluid from a cooling fluid source, such as a cooling fluid channel 90 extending radially outwardly from the root 39 through the airfoil 32. The cooling fluid passages 88 discharge the cooling fluid into the cooling channels 84*a* through outlets at the gas side surface 48.

The platform cover 60*a* illustrated in FIG. 4 may be mounted or attached to the platform member 44 by a welding process, such as by braze welding distal ends 92*a* of the support members 82*a* to the gas side surface 48. The platform cover 60*a* may be formed of the same material or a different material than the platform member 44, such that the particular process forming the connection between the platform cover 60*a* and the platform member 44 may depend on the materials to be joined. Also, the material of the platform member 44 and the platform cover 60*a* may be selected such that the platform member 44 is formed of a higher strength material, while the material of the platform cover 60*a* may be optimized for desired thermal properties to withstand high temperatures. For example, and without limiting the invention, the platform member 44 may be formed of a conventional cast nickel based alloy, while materials that may be used to form the platform cover 60*a* generally may include, but are not limited to, single crystal super alloys, powder metallurgy metals, ceramics, and other materials, including materials that may be readily preformed with contours and those which may provide thermal protection to the platform member 44.

In accordance with one aspect of the platform cover of FIG. 4, the outer edge 66*a* of the platform cover 60*a* may define a planar surface that is generally aligned with the mateface side 54 of the platform member 44, i.e., extending in a generally radial direction. The inner side 78*a* of the platform cover outer edge 66*a* is spaced from the gas side surface 48 to define a mateface seal slot 94*a*, which may have an inner boundary defined by one of the support members 82*a*. The mateface seal slot 94*a* may receive an edge of a mateface seal (not shown) for sealing a gap formed between the airfoil structure 30 and an adjacent airfoil structure (not shown).

Figure 5:
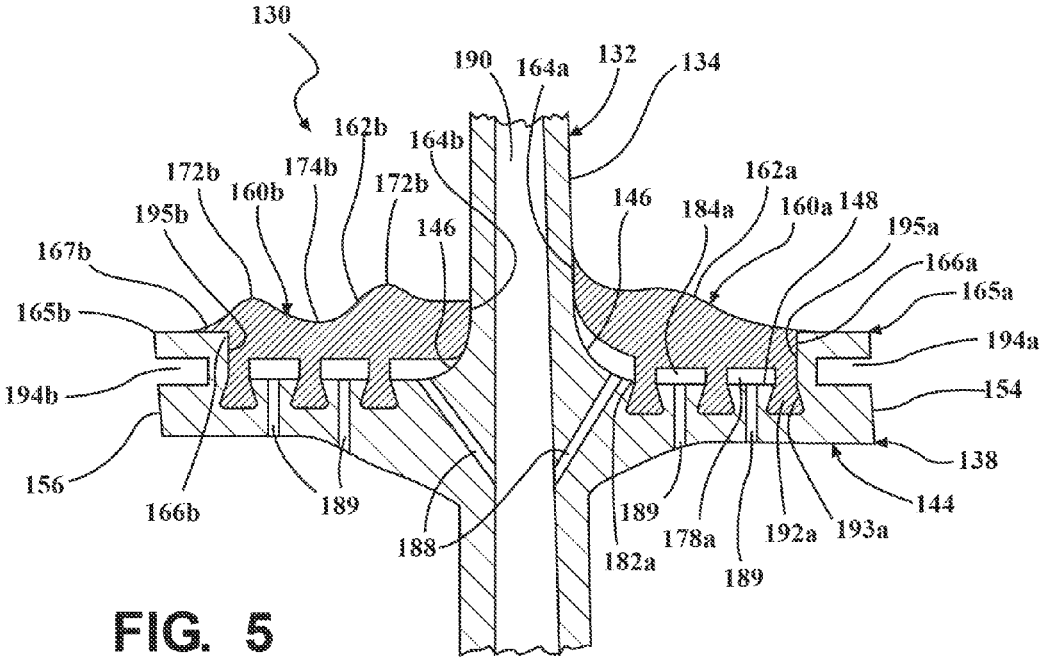
FIG. 5 is a view similar to FIG. 4 illustrating further aspects of the airfoil structure in accordance with the present invention.

Referring to FIG. 5, alternative aspects are illustrated embodied in an airfoil structure 130, where elements of the airfoil structure 130 corresponding to elements of the airfoil structure 30 of FIG. 4 are identified with the same reference numeral increased by 100. The airfoil structure 130 includes a separately formed endwall defined by pressure and suction side platform covers 160*a*, 160*b*. As in the aspects discussed above with regard to the airfoil structure 30 of FIG. 4, the platform covers 160*a*, 160*b* comprise respective outer surfaces 162*a*, 162*b* that may include predetermined contours, such as elevated ridges 172*b* and one or more depressed troughs 174*b*, as illustrated on the platform cover 160*b*.

In accordance with one aspect illustrated in FIG. 5, and with reference to the platform cover 160*a*, the distal ends 192*a* of the support members 182*a* include a form that may be captured in a corresponding form defined by recesses 193*a* in the platform member 144. In the illustrated configuration for the support members 182*a*, the form defined by the distal ends 192*a* and the cooperating recesses 193*a* for receiving the distal ends 192*a* is a dovetail, such as a dovetail configuration that may permit the dovetail distal end 192*a* to slide into position within the dovetail recess 193*a*. That is, the enlarged dovetail ends 192*a* of the support members 182*a* define a form fit connection that may be effective to prevent movement of the platform cover 160*a* in a direction perpendicular to the gas side surface 148, such as to resist a centrifugal force to the platform cover 160*a* during rotation of the rotor 26 (FIG. 1). It should be understood that other form fit connections may be defined by the distal ends 192*a* and recesses 193*a* to retain the platform cover 160*a* in place.

The platform covers 160*a*, 160*b* may be slid into position in any direction, e.g., circumferentially, that is practical for assembling the platform covers to the platform member 144. Further, the different platform covers 160*a*, 160*b* could be configured to slide in different directions as necessary to accommodate positioning of the platform covers 160*a*, 160*b* adjacent to the airfoil 32.

As described above with regard to aspects of the airfoil structure 30 of FIG. 4, cooling channels 184*a* may be formed between an inner side 178*a* of the platform cover 160*a* and a gas side surface 148 of the platform member 144. In accordance with a further aspect, cooling fluid passages 189 may extend through the platform member 144 to provide cooling fluid to the cooling channels 184*a* for discharging the cooling fluid to outlets at the gas side surface 148. A cooling fluid, such as cooling air, passing through the cooling fluid passages 189 may be supplied from a disc cavity defined radially inwardly from the platform member 144. Additionally, cooling fluid passages 188 may receive cooling fluid from a cooling fluid source, such as a cooling fluid channel 190 extending through the airfoil 132, and discharge the cooling fluid through outlets at the gas side surface 148, such as at locations adjacent to the fillet joints 146.

In accordance with a further aspect illustrated in FIG. 5, a first or inner edge 164*a* of the platform cover 160*a* may be located adjacent to or in engagement with the sidewall 134, where the outer surface 162*a* intersects the sidewall 134 at a location that may be radially displaced from the gas side surface 148. A second or outer edge 166*a* may be located adjacent to an edge structure 165*a* of the platform member 144 that defines a mateface side 154. The edge structure 165*a* defines a mateface seal slot 194*a* that may receive a mateface seal (not shown). A side of the edge structure 165*a* opposite from the mateface seal slot 194*a* comprises a generally radially extending wall 195*a* for engagement with the outer edge 166*a* of the platform cover 160*a*. The second or outer edge 166*b* of the suction side platform cover 160*b* illustrates an alternative aspect in which an outer contour portion 167*a* of the platform cover 160*b* may extend circumferentially over at least a portion of the edge structure 165*b*.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A turbine engine airfoil structure comprising:

an airfoil adapted to be supported to extend across a gas passage for a hot working gas in a turbine engine, the airfoil including sidewalls comprising radially extending pressure and suction sides;

a platform structure located at one end of the airfoil and positioned at a location forming a boundary of the gas passage, and including:

a platform member including a gas side surface extending generally perpendicular from the airfoil at a junction with the airfoil, and providing a structural connection to the airfoil; and a separately formed platform cover attached to the platform member at the gas side surface, the platform cover including an outer surface located for contact with the hot working gas passing through the gas path, the outer surface comprising a contoured endwall surface having a first edge located adjacent to one of the sidewalls, wherein the platform cover includes a cooling fluid channel defined between the gas side surface of the platform member and a channel wall formed on the platform cover, the channel wall facing toward the gas side surface, wherein the channel wall comprises a plurality of support members extending from the channel wall and having distal end portions engaged on the platform member for retaining the platform cover to the platform member, wherein the platform cover further comprises a second edge opposite the first edge and located generally aligned with a mateface of the platform member, the second edge being spaced from the mateface of the platform member to define a seal slot therebetween for receiving a mateface seal.

2. The airfoil structure of claim 1, wherein the contoured endwall surface includes a contour comprising at least one of an elevated ridge and a depressed trough.

3. The airfoil structure of claim 1, wherein the first edge is located in engagement with the sidewall and the contoured surface is located adjacent to a fillet joint formed between the airfoil and the platform member, the contoured surface providing a varying contour adjacent to the sidewall and extending in an axial direction between a leading edge and a trailing edge of the airfoil.

4. The airfoil structure of claim 1, including cooling structure formed on a side of the platform cover opposite the outer surface, the cooling structure comprising one or more cooling fluid channels for providing cooling across the gas side surface.

5. The airfoil structure of claim 4, including a cooling fluid passage having an outlet opening at the gas side surface for providing a cooling fluid to the one or more cooling fluid channels.

6. The airfoil structure of claim 1, wherein the platform cover substantially isolates the gas side surface from the hot working gas.

7. The airfoil structure of claim 1, wherein an intersection between the platform cover and the airfoil forms a sharp angle between the outer surface of the platform cover and the sidewall of the airfoil, the sharp angle being defined by an acute angle between the outer surface of the platform cover and the sidewall of the airfoil.

8. A turbine engine airfoil structure comprising:

an airfoil adapted to be supported to extend across a gas passage for a hot working gas in a turbine engine, the airfoil including sidewalls comprising radially extending pressure and suction sides;

a platform structure located at one end of the airfoil and positioned at a location forming a boundary of the gas passage, and including:

a platform member including a gas side surface extending generally perpendicular from the airfoil at a junction with the airfoil, and providing a structural connection to the airfoil; and a separately formed platform cover attached to the platform member at the gas side surface, the platform cover extending from a location radially displaced from the gas side surface and in contact with one of the sidewalls of the airfoil, and including an outer surface located for contact with the hot working gas passing through the gas path, wherein the platform member includes a side edge defining a mateface and the platform cover includes a side edge defining a mateface, and including a slot defined between the gas side surface and the platform cover at the matefaces for receiving a seal member for forming a seal between the platform member and an adjoining platform member.

9. The airfoil structure of claim 1, wherein the support members are attached to the platform member at a welded connection.

10. The airfoil structure of claim 1, wherein the platform member includes recesses for receiving the distal end portions of the support members, the recesses including a form for capturing the distal end portions and preventing movement of the platform cover in a direction generally perpendicular to the gas side surface of the platform member.

11. The airfoil structure of claim 1, wherein the platform cover is formed of a material that is different from the material of the platform member.

* * * * *